US010315739B1

(12) United States Patent
Davis, Jr.

(10) Patent No.: US 10,315,739 B1
(45) Date of Patent: Jun. 11, 2019

(54) KAYAK DOLLY-LIFT SYSTEM

(71) Applicant: James R. Davis, Jr., Belleair Beach, FL (US)

(72) Inventor: James R. Davis, Jr., Belleair Beach, FL (US)

( * ) Notice: Subject to any disclaimer, the term of this patent is extended or adjusted under 35 U.S.C. 154(b) by 0 days.

(21) Appl. No.: 16/054,063

(22) Filed: Aug. 3, 2018

Related U.S. Application Data

(60) Provisional application No. 62/541,959, filed on Aug. 7, 2017.

(51) Int. Cl.
*B63C 3/06* (2006.01)
*B63C 3/12* (2006.01)
*B63C 1/12* (2006.01)

(52) U.S. Cl.
CPC ..... *B63C 3/06* (2013.01); *B63C 1/12* (2013.01); *B63C 3/12* (2013.01)

(58) Field of Classification Search
CPC ..... B63C 3/06
USPC ..... 405/2, 3
See application file for complete search history.

(56) References Cited

U.S. PATENT DOCUMENTS 3,401,806 A * 9/1968 Schmit ..... B63C 3/06 114/366
8,137,028 B2 * 3/2012 Wrobbel ..... B63C 3/00 114/366
8,381,673 B2 * 2/2013 Wirsig ..... B63C 3/06 114/230.16
2010/0247243 A1 * 9/2010 Imel ..... B63B 27/00 405/3
2012/0251242 A1 * 10/2012 Kollar ..... B63C 3/00 405/1
2012/0263533 A1 * 10/2012 Heller ..... G05B 19/106 405/3
2016/0083059 A1 * 3/2016 Kroeger ..... B63C 15/00 405/3
2018/0105237 A1 * 4/2018 Surges ..... B63C 3/12

* cited by examiner

*Primary Examiner* — Benjamin F Fiorello

(57) ABSTRACT

Provided are two drop tubes and two case tubes with each case tube slidably receiving an associated drop tube. A sub-structure below the two drop tubes is formed of two wheels and two side plates. Each side plate is adapted to couple an associated wheel with an associated case tube. A super-structure above the two drop tubes is formed of two wings. Each wing has a C-shaped configuration. The two wings are positionable in a first orientation parallel with the drop tubes. In the first orientation, the two wings are laterally spaced from a vessel when the drop tubes are horizontal for transporting the vessel. The two wings are positionable in a second orientation perpendicular to the drop tubes. In this second orientation, the two wings form a cradle for supporting the vessel thereupon when the drop tubes are vertical for launching and retrieving the vessel.

6 Claims, 3 Drawing Sheets

FIG. 3
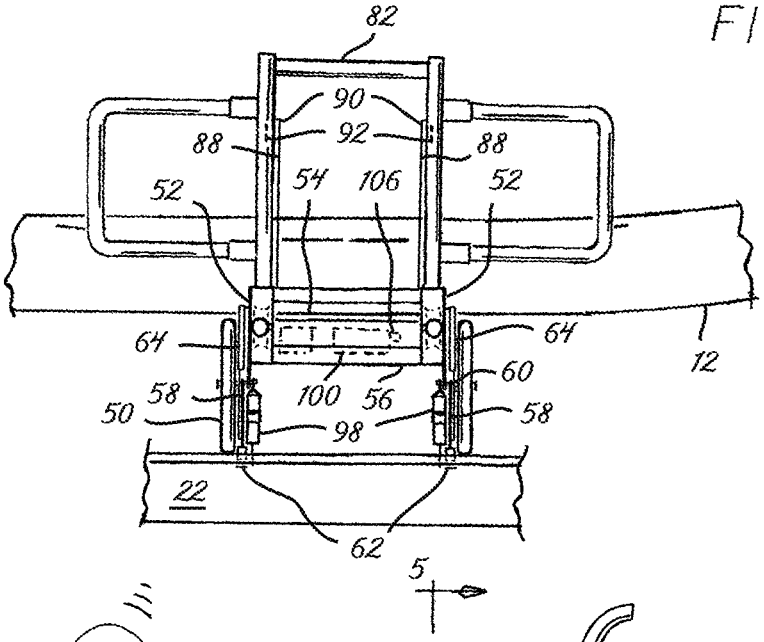
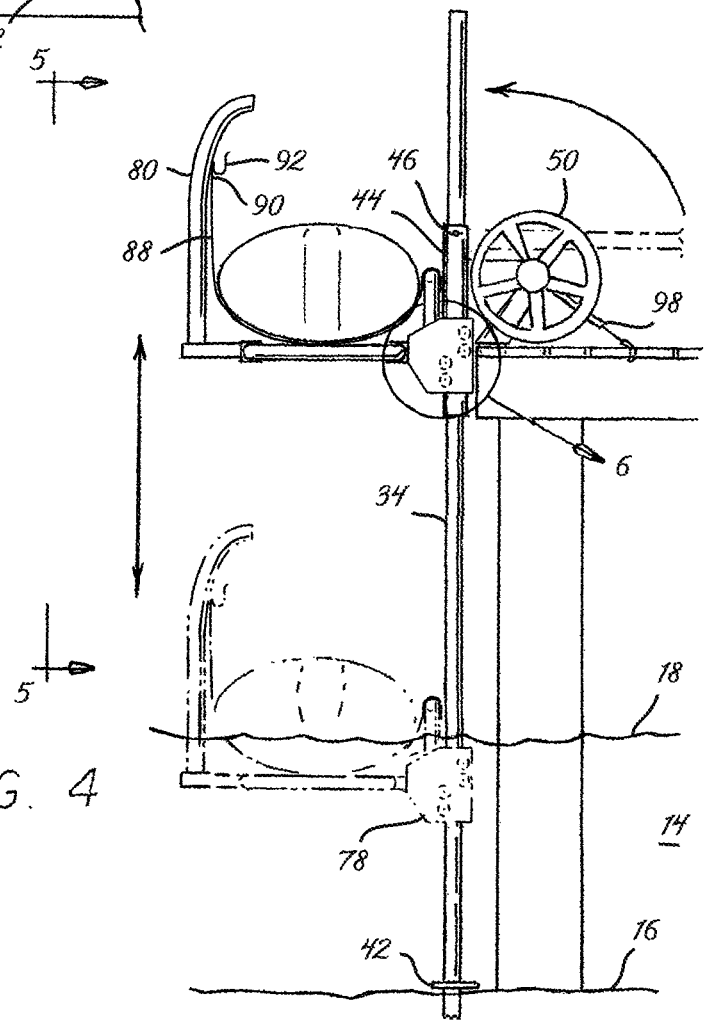
FIG. 4

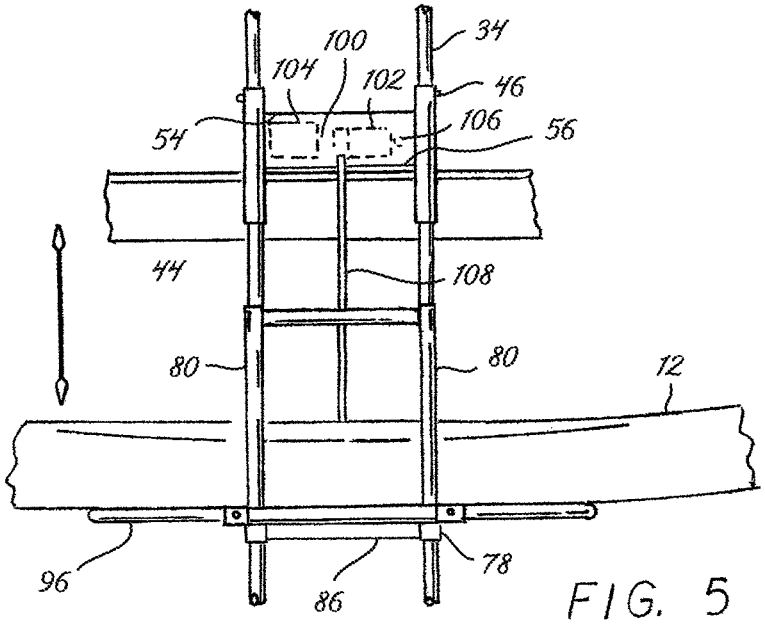
FIG. 5
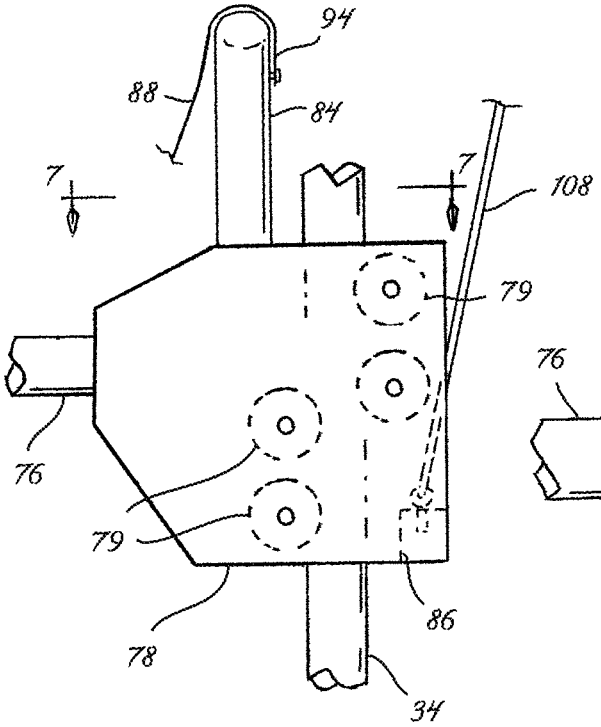
FIG. 6
FIG. 7
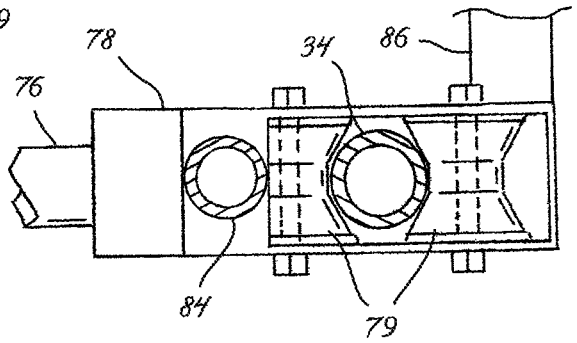

KAYAK DOLLY-LIFT SYSTEM

RELATED APPLICATION

This non-provisional application is based upon and claims priority of Provisional Application No. 62/541,959 filed Aug. 7, 2017, the subject matter of which is incorporated herein by reference.

BACKGROUND OF THE INVENTION

Field Of The Invention

The present invention relates to a kayak dolly-lift system and more particularly pertains to transporting a kayak, and then launching, and retrieving a kayak with its occupant in a safe, convenient, and economical manner.

Description of the Prior Art

The use of kayak handling systems of known designs and configurations is known in the prior art. More specifically, kayak handling systems of known designs and configurations previously devised and utilized for the purpose of transporting, launching and retrieving kayaks are known to consist basically of familiar, expected, and obvious structural configurations, notwithstanding the myriad of designs encompassed by the crowded prior art which has been developed for the fulfillment of countless objectives and requirements.

While known devices fulfill their respective, particular objectives and requirements, they do not describe a kayak dolly-lift system that allows for transporting a kayak, and then launching, and retrieving a kayak with its occupant in a safe, convenient, and economical manner.

In this respect, the kayak dolly-lift system according to the present invention substantially departs from the conventional concepts and designs of the prior art, and in doing so provides an apparatus primarily developed for the purpose of transporting a kayak, and then launching, and retrieving a kayak with its occupant in a safe, convenient, and economical manner.

Therefore, it can be appreciated that there exists a continuing need for a new and improved kayak dolly-lift system which can be used for transporting a kayak, and then launching, and retrieving a kayak with its occupant in a safe, convenient, and economical manner. In this regard, the present invention substantially fulfills this need.

SUMMARY OF THE INVENTION

In view of the disadvantages inherent in the known types of kayak handling systems of known designs and configurations now present in the prior art, the present invention provides an improved kayak dolly-lift system. As such, the general purpose of the present invention, which will be described subsequently in greater detail, is to provide a new and improved kayak dolly-lift system and method which has all the advantages of the prior art and none of the disadvantages.

To attain this, from a broad perspective, first provided is a dolly-lift. The dolly-lift includes two drop tubes and two case tubes. Each case tube is adapted to slidably receive an associated drop tube. A sub-structure below the two drop tubes formed of two wheels and two side plates. Each side plate is adapted to pivotably couple an associated wheel with an associated case tube. A super-structure above the two drop tubes is formed of two wings. Each wing has a C-shaped configuration. The two wings have a first orientation parallel with the drop tubes for transporting a vessel. The two wings have a second orientation perpendicular to the drop tubes to support the vessel. The drop tubes are adapted to be rotated into a vertical position for launching and retrieving the vessel.

There has thus been outlined, rather broadly, the more important features of the invention in order that the detailed description thereof that follows may be better understood and in order that the present contribution to the art may be appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved kayak dolly-lift system which has all the advantages of the prior kayak handling systems of known designs and configurations and none of the disadvantages.

It is another object of the present invention to provide a new and improved kayak dolly-lift system which may be easily and efficiently manufactured and marketed.

It is a further object of the present invention to provide a new and improved kayak dolly-lift system which is of durable and reliable constructions.

An even further object of the present invention is to provide a new and improved kayak dolly-lift system which is susceptible of a low cost of manufacture with regard to both materials and labor, and which accordingly is then susceptible of low prices of sale to the consuming public, thereby making such kayak dolly-lift system economically available.

Lastly, it is an object of the present invention to provide a kayak dolly-lift system for transporting a kayak, and then launching, and retrieving a kayak with its occupant in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevational view taken along line 3-3 of FIG. 1 with the kayak rotated about 90 degrees.

FIG. 4 is an enlarged showing of the system after turning the drop tubes about 90 degrees, from generally horizontal to vertical.

FIG. 5 is a cross sectional view taken along line 5-5 of FIG. 4.

FIG. 6 is an enlarged showing of a roller assembly spanning an associated drop tube.

FIG. 7 a cross sectional view taken along line 7-7 of FIG. 6.

The same reference numerals refer to the same parts throughout the various Figures.

DESCRIPTION OF THE PREFERRED EMBODIMENT

Figure 1:
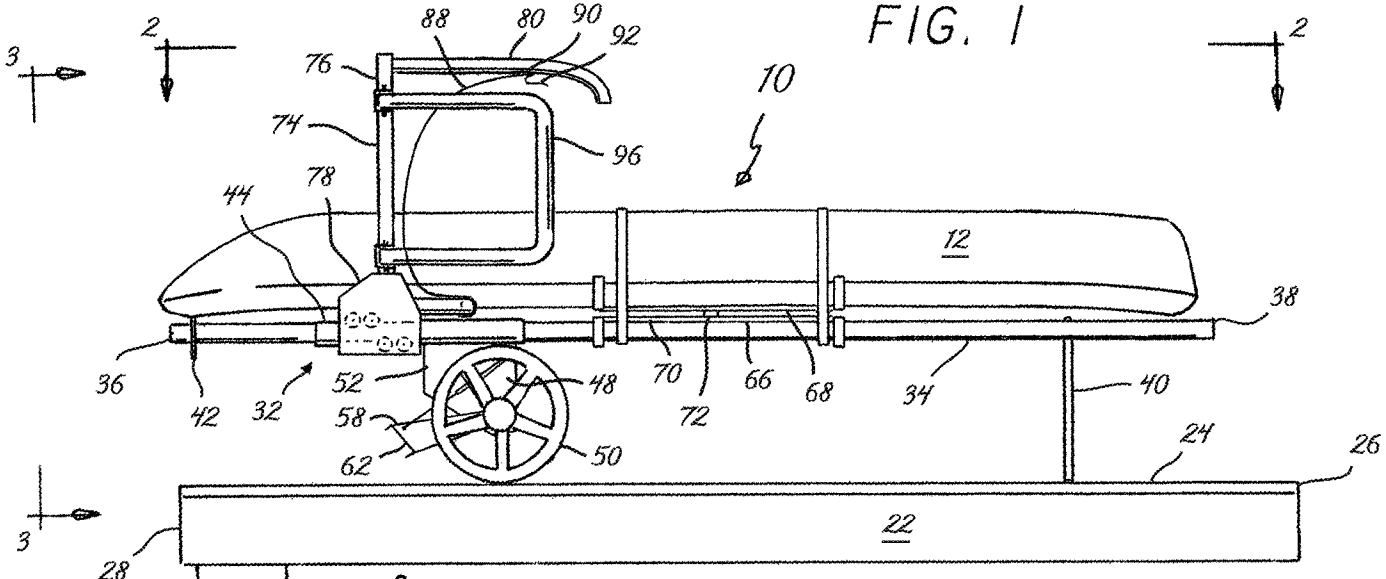
FIG. 1 is a side elevational view of a kayak dolly-lift system constructed in accordance with the principles of the present invention.

With reference now to the drawings, and in particular to FIG. 1 thereof, the preferred embodiment of the new and improved kayak dolly-lift system embodying the principles and concepts of the present invention and generally designated by the reference numeral 10 will be described.

The present invention, the kayak dolly-lift system 10 is comprised of a plurality of components. Such components are individually configured and correlated with respect to each other so as to attain the desired objective. In their broadest context such include a pair of drop tubes, two case tubes, a sub-structure, a turn cradle, and a super-structure.

In the preferred embodiment of the kayak dolly-lift system, designated by reference numeral 10, first provided is a body of water 14. The body of water has a bed 16 below and a waterline 18 above. A dock 22 has a support surface 24 horizontally disposed above. The support surface has a rearward end 26 and a forward end 28. Pilings 30 extend downwardly from the support surface adjacent to the forward end and project into the bed.

Next provided is a dolly-lift 32. The dolly-lift includes two drop tubes 34 which are parallel, laterally spaced, and generally horizontally disposed. Each drop tube has a distal end 36 located adjacent to the forward end of the dock and a proximal end 38 located adjacent to the rearward end of the dock. Two vertical supports 40 are positioned adjacent to the proximal end of each drop tube. The vertical supports have a length configured to contact the support surface when the two drop tubes are in a horizontal position. Each drop tube further has a cylindrical plate 42 adjacent to the distal end. Two case tubes 44 are adapted to slidably receive an associated drop tube. Each case tube has a locking pin 46 to disable the associated drop tube movement.

Further provided is a sub-structure 48 below the drop tubes. The sub-structure is formed of two wheels 50 and two side plates 52. Each wheel has a horizontal axis and a preferred 20 inch diameter plus or minus 20 percent. Each side plate is adapted to pivotably couple an associated wheel with an associated case tube. An upper bracket 54 and a lower bracket 56 laterally connect both side plates. Two lower arms 58 each have a top end 60 and a bottom end 62. The top end of each lower arm is pivotably coupled to the horizontal axis of an associated wheel. The bottom of each lower arm is adapted to couple with the support surface of the dock. Two extendable gas springs 64 are adapted to operatively couple the bottom end of an associated lower arm with an associated side plate.

Figure 2:
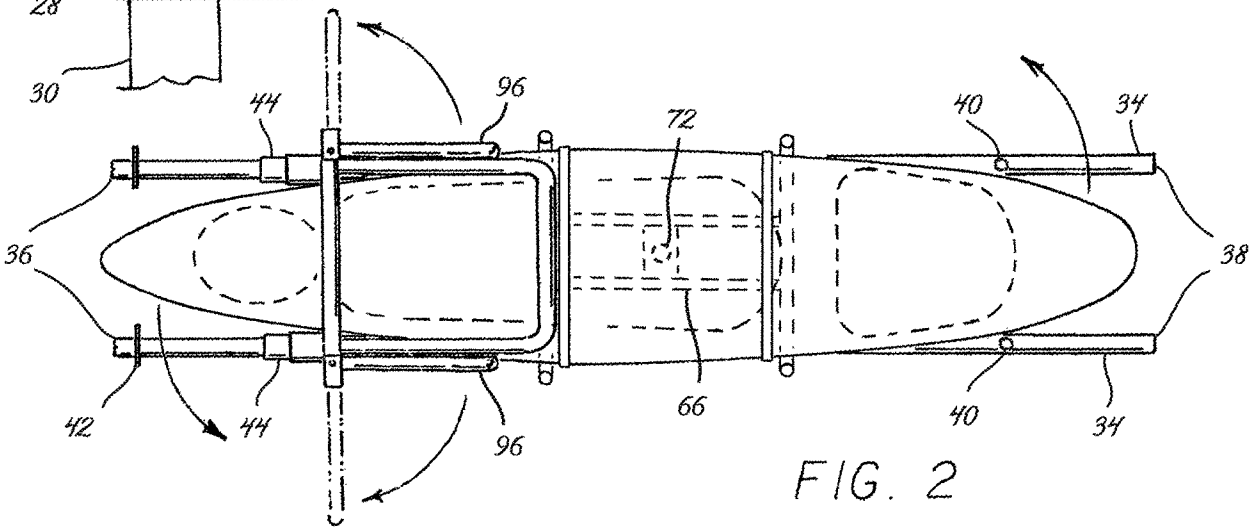
FIG. 2 is a plan view of the system taken along line 2-2 of FIG. 1.

A turn cradle 66 is provided next. The turn cradle has a lower frame 68 and an upper frame 70. The lower frame is adapted to cradle both of the drop tubes and provide longitudinal movement. The upper frame adapted to support the kayak. A spindle 72 is positioned between the upper frame and the lower frame. The spindle is adapted to allow rotational movement between the kayak and the two drop tubes. The turn cradle allows a user to move the kayak both longitudinally and rotationally along the drop tubes, as shown in FIGS. 2 and 3.

Next a super-structure 74 is provided above the two drop tubes. The super-structure is formed of two vertical members 76. Each vertical member has a roller assembly 78 spanning an associated drop tube adjacent to the distal end. Each roller assembly has a plurality of rollers 79 positioned above and below an associated drop tube. Each vertical member has a forward member 80 extending rearwardly and downwardly in an arcuate configuration. The forward members are connected by a forward rod 82. An upper and a lower cross member 84, 86 are adapted to couple each roller assembly together in a parallel position. The upper cross member has a substantially C-shaped configuration.

Further provided are two support straps 88. Each support strap has a first end 90 that is coupled with a paddle hook 92 and secured to an associated vertical member. Each support strap has a second end 94 secured to the upper cross member respectively.

Two wings 96 are provided next. Each wing has a C-shaped configuration. Each wing further has a free end pivotably coupled to an associated vertical member. The two wings are positionable in a first orientation parallel with the drop tubes. In the first orientation, the two wings are laterally spaced from the kayak when the drop tubes are in a horizontal position for transporting the kayak, as shown in FIGS. 1 and 2. In FIG. 3, the two wings are positioned in a second orientation perpendicular to the drop tubes. In the second orientation, the two wings form a cradle for supporting the kayak thereupon when the drop tubes are rotated to a vertical position, as shown in FIGS. 4 and 5. The vertical position is for launching and retrieving the kayak.

Further provided are two safety straps 98. Each safety strap has a quick clip adapted to secure the dolly-lift to the dock.

Even further provided is a power assembly 100. The power assembly is positioned between the upper and lower brackets of the sub-structure. The power assembly includes a winch 102, a source of power 104, a receiver 106, and a cable 108. The cable is adapted to couple the super-structure and the winch for lowering and raising the kayak.

Lastly provided is a remote 110. The remote transmits a signal to the receiver to activate the winch motion.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A vessel dolly-lift system comprising:

a dolly-lift including two drop tubes and two case tubes, each case tube slidably receiving an associated drop tube;

the dolly-lift further including a sub-structure below the two drop tubes formed of two wheels and two side plates, each side plate pivotably coupling an associated wheel with an associated case tube;

the dolly-lift further including a super-structure above the two drop tubes formed of two wings each having a C-shaped configuration, the two wings positionable in a first orientation parallel with the drop tubes, the two wings being laterally spaced from the vessel when the drop tubes are horizontal for transporting the vessel, the two wings positionable in a second orientation perpendicular to the drop tubes to form a cradle for supporting a vessel thereupon when the drop tubes are vertical for launching and retrieving the vessel.

2. The system as set forth in claim 1 and further including two safety straps with quick clips securing the dolly-lift to a dock.

3. The system as set forth in claim 2 and further including two lower arms being pivotably coupled to an associated wheel and adapted to engage with an upper surface of the dock.

4. The system as set forth in claim 1 and further including a power assembly formed of a winch and a source of power and a cable coupling the cradle and the winch for lowering and raising the vessel.

5. The system as set forth in claim 4 and further including a remote for transmitting a signal to the receiver to activate the winch.

6. A kayak dolly-lift system (10) for transporting, launching, and retrieving a kayak (12), the transporting, launching, and retrieving being done in a safe, convenient, and economical manner, the system comprising, in combination:

a body of water (14) with a bed (16) below and a waterline (18) above;

a dock (22) with a support surface (24) horizontally disposed above, the support surface having a rearward end (26) and a forward end (28), pilings (30) extending downwardly from the support surface adjacent to the forward end and projecting into the bed;

a dolly-lift (32) including two drop tubes (34) parallel, laterally spaced, and generally horizontally disposed, the two drop tubes each having a distal end (36) located adjacent to the forward end of the dock, the two drop tubes each having a proximal end (38) located adjacent to the rearward end of the dock, two vertical supports (40) each positioned adjacent to the proximal end of each drop tube, each drop tube having a cylindrical plate (42) adjacent to the distal end, two case tubes (44) each slidably receiving an associated drop tube, two locking pins (46) adapted to disable drop tube movement within each case tube;

the dolly-lift further including a sub-structure (48) below the two drop tubes formed of two wheels (50) having a 20 inch diameter plus or minus 20 percent, the two wheels having a horizontal axis, two side plates (52) each pivotably coupled to an associated wheel with an associated case tube, an upper bracket (54) and a lower bracket (56) laterally connecting both side plates, two lower arms (58) each having a top end (60) and a bottom end (62), each top end being pivotably coupled to the horizontal axis of an associated wheel, an extendable gas spring (64) operatively coupling each bottom end to an associated side plate;

a turn cradle (66) having a lower frame (68) and an upper frame (70) coupled by a spindle (72), the upper frame supporting the kayak for rotational movement and the lower frame cradling each drop tube for longitudinal movement;

the dolly-lift further including a super-structure (74) above the two drop tubes formed of two vertical members (76) each having a roller assembly (78) spanning associated drop tubes adjacent to the distal end, each roller assembly having a plurality of rollers (79) positioned above and below an associated drop tube, the two vertical members having forward members (80) extending rearwardly and downwardly in an arcuate configuration, the forward members being connected by a forward rod (82), each roller assembly being coupled by an upper cross member (84) and a lower cross member (86), the upper cross member having a C-shaped configuration;

a pair of support straps (88) having a first end (90), a paddle hook (92) is coupled with each first end and secured to an associated vertical member, each support strap having a second end (94) secured to the upper cross member;

two wings (96) each having a C-shaped configuration with free ends pivotably coupled to the vertical members respectively, the two wings positionable in a first orientation parallel with the drop tubes, the two wings being laterally spaced from the kayak when the drop tubes are horizontal for transporting the kayak, the two wings positionable in a second orientation perpendicular to the drop tubes to form a cradle for supporting the kayak thereupon when the drop tubes are vertical for launching and retrieving the kayak;

two safety straps (98) having quick clips securing the dolly-lift to the dock;

a power assembly (100) positioned between the upper and lower brackets including a winch (102) and a source of power (104) and a receiver (106) and a cable (108) coupling the super-structure and the winch for lowering and raising the kayak; and a remote (110) for transmitting a signal to the receiver to activate the winch.

* * * * *